United States Patent [19]

Dance et al.

[11] Patent Number: 4,582,999

[45] Date of Patent: Apr. 15, 1986

[54] THERMAL NEUTRON COLLIMATOR

[75] Inventors: William E. Dance, Dallas; Sammy F. Carollo, Irving, both of Tex.

[73] Assignee: LTV Aerospace and Defense Company, Dallas, Tex.

[21] Appl. No.: 483,847

[22] Filed: Apr. 13, 1983

Related U.S. Application Data

[63] Continuation of Ser. No. 237,230, Feb. 23, 1981.

[51] Int. Cl.[4] ..... G21K 1/02

[52] U.S. Cl. ..... 250/505.1; 250/518.1; 378/147

[58] Field of Search ..... 250/251, 505.1, 515.1, 250/518.1, 358.1, 359.1, 390, 391, 392; 378/147; 376/190

[56] References Cited

U.S. PATENT DOCUMENTS

| | | | |
|---|---|---|---|
| 3,056,028 | 9/1962 | Mattingly | 250/518.1 |
| 3,781,564 | 12/1973 | Lundberg | 250/505 |
| 4,192,998 | 3/1980 | Azam | 376/190 |
| 4,300,054 | 11/1981 | Dance et al. | 376/190 |

OTHER PUBLICATIONS

Meister et al., "Neutron Collimators with Plates of Self-Contracting Foils", Nuc. Instru. and Meth., 108 (1), Apr. 1, 1973, pp. 107–111.

Vasilik et al., "Thermal-Neutron Radiography with a Sealed-Tube Neutron Generator and Water Moderator", Nuc. Tech. 14 (3), Jun. 1972, pp. 279–283.

Vasilik et al., "Neutron Radiography with a Sealed--Tube Neutron Generator and Graphite Moderator System", Materials Evaluation, Jun. 1971, pp. 130–132.

Spowart, "Use of a 10" n/sec Neutron Generator for Neutron Radiography", Nucl. Instru. & Methods, 92 (4), pp. 613–617, 1971.

*Primary Examiner*—Alfred E. Smith
*Assistant Examiner*—Carolyn E. Fields
*Attorney, Agent, or Firm*—J. M. Cate; S. S. Sadacca

[57] ABSTRACT

In a system for generating thermal (14 MeV) neutrons containing an ionic accelerator, a novel thermal neutron collimator for producing a beam of collimated thermal neutrons is disclosed. The apparatus includes a substantially hollow collimator tube (10) having a closed, neutron permaeable inlet portion (20) communicating with a source of thermal neutrons (12) and an open outlet portion (22) disposed downstream of the inlet portion at the opposite end of the tube. The collimator walls (14,16,18) diverge outwardly toward the outlet portion of the tube and are formed of three radial layers comprising an outer layer of thermal neutron absorbing material (26) for absorbing off-axis thermal neutrons, an intermediate layer of lead (24) for absorbing X-rays and gamma rays and an inside layer of aluminum (23) for structural support.

15 Claims, 4 Drawing Figures

THERMAL NEUTRON COLLIMATOR

This application is a continuation, of application Ser. No. 237,230, filed Feb. 23, 1981.

TECHNICAL FIELD

This invention relates to collimators for neutrons and more particularly to collimators for deriving highly directed thermal neutron beams from fast neutron beams for use in neutron radiography.

BACKGROUND ART

Neutron ray generators have recently been developed for a variety of uses. Most conventional neutron generation systems are employed in the technique of neutron activation analysis in which high energy (fast) neutrons generated by directing an ion beam in an accelerator tube are directed at a suitable target which then emits high energy neutrons. The composition of the test material radiated with high energy neutrons is determined by analyzing the emissions therefrom.

In other applications, such as neutron radiography or in some instances neutron ray therapy, high energy (fast) neutrons are not suitable, and such fast neutrons must be reduced to lower energy (thermal) neutrons by discharging a high energy neutron beam into a suitable moderator medium. Since the thermalized neutrons produced in the moderator medium are randomly scattered and isotropic, a directional component of the thermal neutrons must be collected to provide a directed neutron beam. Furthermore, since substantial background neutron, X-ray and gamma ray radiation cannot be tolerated in neutron radiography or neutron ray therapy applications, a thermal neutron collimator is needed for providing a highly directed thermal neutron beam without substantial background neutron, X-ray, gamma ray, or fast neutron radiation. Such a collimator must be effective when used with neutron generator sources having primary neutron energies as high as approximately 14 million electron volts (MeV).

DISCLOSURE OF THE INVENTION

In accordance with the present invention, a thermal neutron collimator is provided for producing a directed beam of thermal neutrons from a primary neutron source emitting fast neutrons with energies up to 14 MeV. The collimator comprises a hollow tube having a neutron permeable inlet portion communicating with a source of thermal neutrons and an outlet portion disposed downstream of the inlet portion at the opposite end of the tube. The cross-sectional area of the tube increases at a constant rate toward the outlet portion of the tube. The walls of the tube are formed of a three-ply material in which an outer layer of cadmium is provided for absorbing off-axis thermal neutrons, an intermediate layer of lead is provided for absorbing X-rays and gamma rays and an inside layer of aluminum is provided for structural support.

In accordance with another embodiment of the invention, apparatus is disclosed for producing a collimated beam of thermal neutrons. A high voltage source is selectively connected to an ion accelerator neutron tube for selectively producing a stream of high energy neutrons. A moderator material surrounds the output portion of the neutron tube for rapidly diffusing the fast neutron energy into randomly scattered thermal neutron energy. A collimator tube is provided with a relatively narrow neutron permeable input portion disposed in the moderator material for admitting neutrons travelling generally parallel to the axis of the tube. The walls of the tube are formed of a three-ply material in which an outer layer of cadmium is provided for absorbing off-axis thermal neutrons, an intermediate layer of lead is provided for absorbing X-rays and gamma rays and an inside layer of aluminum is provided for structural support.

In accordance with yet another embodiment of the invention, a method for collimating thermal neutrons for radiography is disclosed. A high voltage source is selectively applied to an ion accelerator neutron tube to generate a stream of fast or high energy neutrons. The high energy neutrons are discharged into the moderator medium to produce randomly diffused thermal neutrons. A collimator tube collects a directional component of the thermal energy neutrons having substantially the same direction as the axis of the tube. The thermal energy neutrons are collimated in a collimator tube by absorbing the off-axis thermal neutrons colliding with the walls of the tube to produce a collimated beam of thermal energy neutrons. X-rays and gamma rays produced in the ion accelerator tube and/or in the moderator medium are absorbed by the collimator tube to reduce background radiation. A collimated beam of thermal energy neutrons is then discharged from the tube.

DETAILED DESCRIPTION

Figure 1:
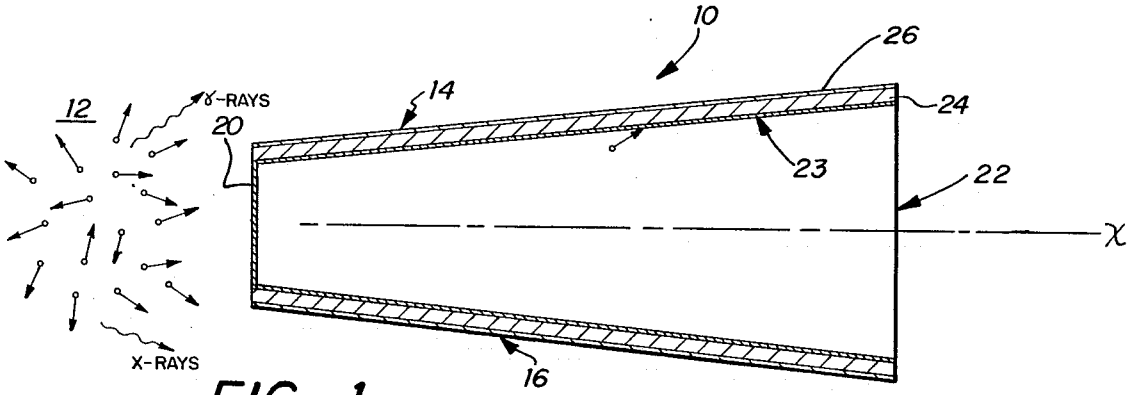
FIG. 1 is a section view of a thermal neutron collimator tube.

Referring to FIG. 1, a collimator tube 10, illustrated in cross-section, is disposed in proximity to an isotropic thermal neutron field 12, schematically represented by a plurality of points with arrows indicating the direction of travel of the neutrons.

Figure 2:
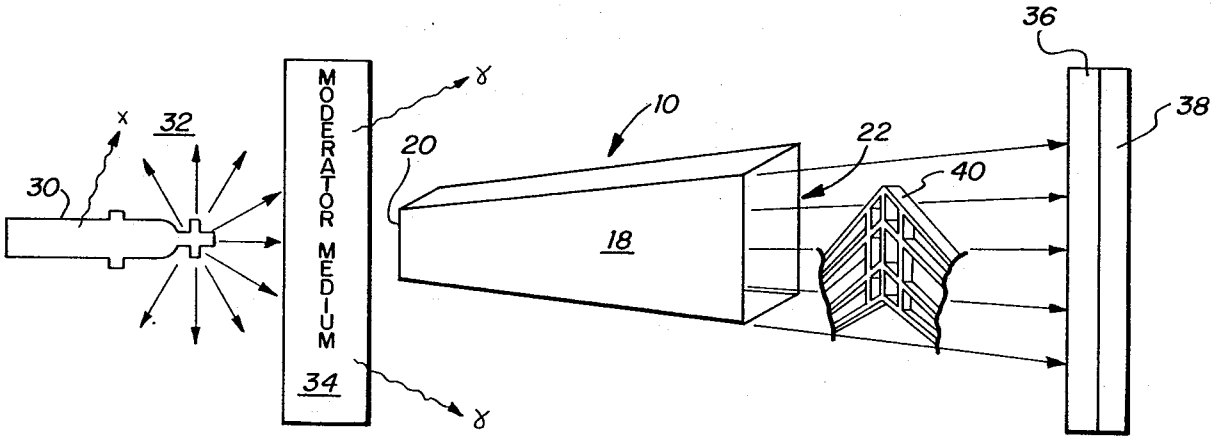
FIG. 2 is a schematic view of a thermal collimator tube illustrating its use in neutron radiography applications.

Collimator tube 10 comprises a generally rectangular hollow tube having four walls, top wall 14, bottom wall 16 (FIG. 1) and two side wall 18 (FIG. 2). As shown in FIGS. 1 and 2, walls 14, 16 and 18 diverge at a constant rate in the downstream direction of the tube, the rate of divergence and the length of the tube being experimentally determined to produce a beam of suitable width and to reduce background neutron, X-ray and gamma ray radiation while maintaining the resulting thermal neutron flux at acceptable levels.

Collimator tube 10 is closed at its narrow end by a neutron permeable material which acts as an inlet 20 for the thermal neutrons. At its diverging end, the collimator tube is open to form an outlet 22 for the collimated thermal neutral beam. In the preferred embodiment, walls 14, 16 and 18 are formed of a laminated three-ply material comprised of an outside layer of cadmium, an intermediate layer of lead and an inside layer of lightweight aluminum. The inside layer of lightweight aluminum, which provides structural support, has minimum thickness necessary to support the weight of the collimator and the absorbing materials bonded to the surface thereof. For a collimator approximately thirty inches long, for example, an aluminum layer 23 approximately 0.063 inches thick is sufficient. The inlet 20 is a single layer of aluminum of the same thickness.

Although the inlet 20 admits only a fraction of the neutrons in field 12 traveling generally in the direction of the axis X of the collimator, some off-axis thermal neutrons will pass through the inlet 20 and other off-axis neutrons outside the collimator may pass through the aluminum walls. Substantial elimination of these off-axis neutrons is vital in neutron radiography because otherwise such background radiation will compromise the quality of the photographic images obtained. Likewise, in neutron ray ray therapy, background neutron radiation is undesirable because it poses a risk to health. Moreover, since the thermal neutron field 12 may also contain X-ray and gamma ray radiation which will directly expose the photographic plates or, in neutron ray therapy application create a serious hazard to health, the collimated beam must be shielded from and absorb such radiation.

It has been found that the background thermal neutron, X-ray and gamma ray radiation can be reduced by providing the walls of the collimator tube with layers of thermal neutron, X-ray and gamma ray absorbing materials in suitable thickness and with a specified geometry.

FIG. 1 illustrates the geometry of the collimator walls containing two layers of absorbing material. In the preferred embodiment, an X-ray and gamma ray absorbing material 24 is adhesively bonded directly to the aluminum layer 23 and a thermal neutron absorbing layer 26 is adhesively bonded to the X-ray and gamma ray absorbing material 24, such that the aluminum layer 23 forms the inside surface of the collimator walls, the X-ray and gamma ray absorbing material the intermediate layer and the thermal neutron absorbing layer the outer surface of the walls. In thermal neutron radiography applications, suitable reduction of background X-ray, gamma ray and thermal neutral radiation is possible by sandwiching the X-ray and gamma ray absorbing material 24 between the aluminum layer 23 and the thermal neutron absorbing layer 26. A layer of lead approximately 0.3125 (5/16) inches thick interposed between the 0.063 inch aluminum layer and a 0.04 inch cadmium layer provides optimal reduction of background radiation for up to about 14 MeV neutron sources and yields a high quality neutron radiograph on standard X-ray film.

While the use of collimator tube 10 is not restricted to thermal neutral radiography applications, its greatest utility so far has been found in thermal neutron radiography, particularly in portable neutron ray inspection heads. Such a portable, on/off neutron ray inspection system is disclosed in a copending application of William E. Dance and Harry N. Bumgardner, Jr., Ser. No. 118,150, filed Feb. 4, 1980, now U.S. Pat. No. 4,300,054, entitled "Directionally Positionable Neutron Beam." FIG. 2 shows schematically the use of the collimator tube 10 in such a system. An ion accelerator neutron tube 30 is energized by selectively applying a high voltage thereto, resulting in the discharge of high energy neutrons (arrows), X-rays and gamma rays (wavy arrows). Since high energy neutrons are unsuitable for thermal neutron radiography applications, the high energy neutrons are discharged into a moderator medium 34, which scatters and diffuses the neutrons and reduces the energy of the neutrons from approximately 14 MeV coming off target to approximately 0.025 eV in the moderator medium, a reduction in energy on the order of $10^8$. Depending upon where the collimator is positioned, a directional component of thermal neutrons more or less parallel to the axis of the collimator will be collected through the neutron permeable inlet 20. Thermal neutrons which pass through the inlet, but which are substantially off-axis will collide with the thermal neutron absorbing layer 26 (FIG. 1) of the collimator where they will be absorbed. Neutron absorbing material 26 will also shield the collimated beam from any thermal neutrons passing through the side walls of the collimator. Similarly, the X-ray and gamma ray absorbing material 24 disposed between the cadmium and aluminum layers shields the collimated beam from X-ray and gamma ray radiation. The particular geometry and relative thicknesses of the layers appear to be important factors in obtaining high quality radiographs.

FIG. 2 also illustrates the use of the collimated beam in neutron radiography applications. The collimated neutron beam exposes a photographic plate 36 of standard X-ray film coated with a layer of gadolinium foil 38 or other neutron converter material behind the object 40 under examination. Since the thermal neutrons passing through the object 40 will not effectively expose X-ray film, a layer of gadolinium 38 will facilitate exposure of the X-ray film by emitting electrons in response to the thermal neutron flux.

The geometry of the collimator tube 10 also plays an important role in achieving a high quality thermal neutron radiograph image. The length of the collimator tube and the rate of divergence of the walls are experimentally determined to reduce background radiation to an acceptable level while simultaneously providing a thermal neutron flux of sufficient intensity and width to obtain a good image on a plate of conventional X-ray film when an appropriate converter material is used. For example, where an 8 by 10 inch beam width is desired for use with a standard 8 by 10 inch photographic plate, a collimator tube with a 30 inch axis, a 2.5 by 2.5 inch inlet and an 8 by 10 inch outlet produces a good quality radiograph. Optimally, the walls of the rectangular collimator should diverge at a constant rate of about 5–7 degrees. While some variation in the rate of divergence of the walls is tolerable, it has been found that a divergence of more than 10 degrees results in a poor quality radiograph. For example, in the 30 inch collimator tube having an $8\times10$ inch opening, optimum resolution was achieved when the top and bottom walls 14 and 16 diverged to an 8 inch width at an angle of about 5.7 degrees and the side walls 18 diverged to a 10 inch width at about 7.125 degrees.

Figure 3:
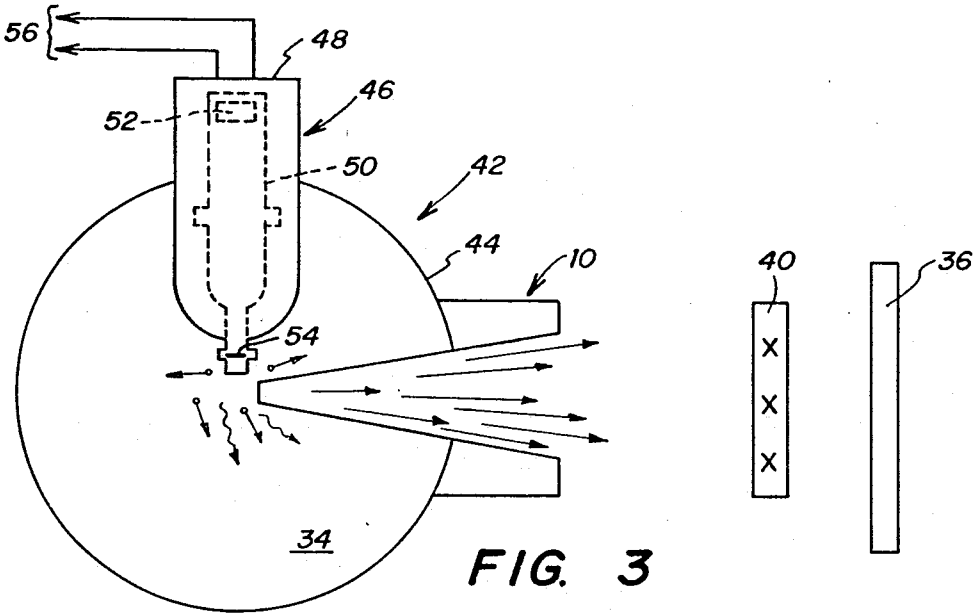
FIG. 3 is a schematic representation of a thermal neutron collimator tube employed in a portable neutron ray inspection head.

Referring now to FIG. 3, the neutron collimator 10 is shown as it is employed in an on/off portable thermal neutron beam inspection head 42 adapted to rotate in a spherical housing 44. In this embodiment, a neutron generator 46 having an elongated housing 48 is mounted with its longitudinal axis coincident with the spherical axis of housing 44. Housing 48 contains an elongated evacuated tube 50 having a positive ion source 52 near one end thereof and a tritium target 54 at the opposite end. Upon bombardment by ions generated in tube 50, the tritium target emits high energy neutrons.

Although various types of neutron sources may be employed in thermal neutron radiography applications for use in portable neutron radiography systems, an on/off switchable ion source is desirable because the hazards of conventional continuous radioisotopic sources are thereby minimized. Illustrative of the generators of the on/off type is the sealed tube 14 MeV neutron generator such as the Model A-711 manufactured by Kaman Sciences Corporation. This neutron generator comprises an elongated cylindrical housing with a target at one end and a plurality of high voltage inputs 56 at the opposite end. Voltages can thereby be selectively applied to the accelerator tube to generate 14 MeV fast neutrons when desired.

As earlier indicated, the high energy (fast) neutrons emitted by target 54 are not suitable for thermal neutron radiography. Accordingly, the energy must be reduced by suitable moderation to provide lower energy thermal neutrons. Moderation of fast neutrons is accomplished by submerging the target 54 in a moderator fluid such as water or a suitable organic fluid such as high purity transformer oil. Accordingly, spherical housing 44 is filled with suitable moderator fluid 34 so that high energy neutrons emitted by the target collide with the hydrogen protons in the moderator fluid giving up energy to the fluid as they diffuse therethrough. The radius of spherical housing 44 is determined by the energy of the fast neutrons admitted in the moderator fluid to that the neutrons emitted from the target will be effectively moderated or thermalized by multiple collisions by the time they diffuse to the inlet 20 of the collimator tube.

Since the inlet 20 of the collimator tube is closed and formed of aluminum, it seals the collimator from the moderator fluid so that thermal neutrons admitted to the tube pass through relatively unattenuated. Since the outlet portion 22 of the tube opens externally of the spherical housing, it may be open.

Since the diffusion of thermal neutrons is spatially homogenous, the angle which the axis of the collimator tube 10 is disposed to the center of the spherical housing is unimportant and inlet 20 will observe a uniform thermal neutron flux at any angle. Thus, the thermal neutron flux available at the inlet remains relatively constant regardless of the rotational position of the collimator 10 to the generator. Adjustment in the width of the thermal neutron beam or viewing field may be made as required by the variation of the distance between the inlet 20 and the film plane.

Figure 4:
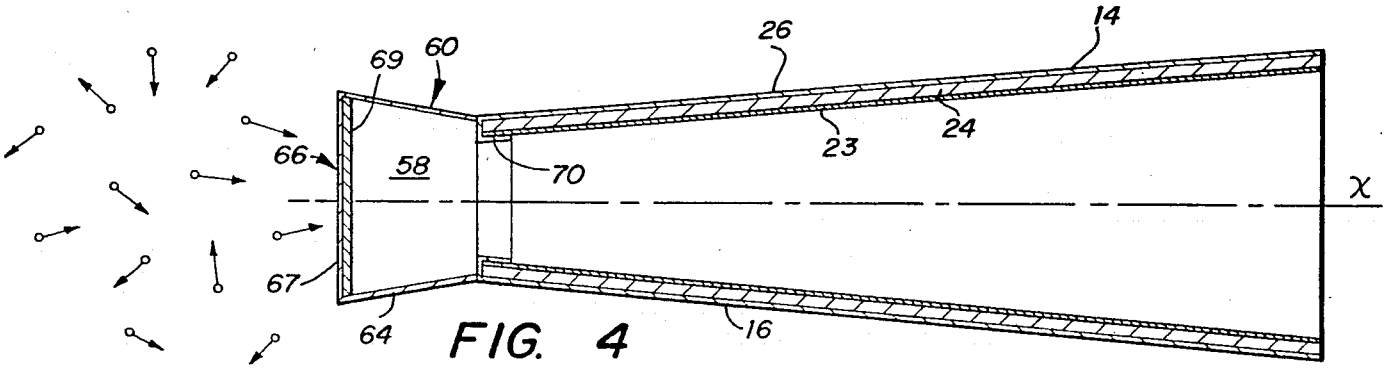
FIG. 4 is a section view of another embodiment of the thermal neutron collimator tube showing the flared structure adjacent the inlet portion of the collimator tube.

FIG. 4 illustrates another embodiment of the invention in which the collimator tube 10 is fitted with a flared structure 60 upstream of the inlet to increase collection of thermal neutron flux at the inlet. In this embodiment, the inlet is completely open. Structure 60 displaces a portion of the moderator fluid by an air gap 58 which permits additional thermal neutrons passing between the diverging side walls 64 of the structure to reach inlet 20 unattenuated. The four side walls 64 are closed by forward wall 66 which isolates the interior of the collimator from the moderator fluid, yet permits the passage of thermal neutrons therethrough. Wall 66, formed of two layers of material, contains an outer layer of aluminum 67 having a thickness of about 0.063 inches with an inside layer of lead 69 having a thickness of about 0.125 inches. Layer 69 filters or removes low energy gamma rays while allowing passage of thermal neutrons into the collimator relatively unattenuated. Side walls 64 are likewise formed of aluminum and have the same thickness as walls 14, 16, 18.

As seen in FIG. 4, the neutron absorbing layer 26 may be disposed around the periphery of the open inlet to form a lip 70 on the inside wall of the collimator. Lip 70 therefore provides a thermal neutron absorbing material at the inlet periphery to more sharply define the incident neutron flux.

While the invention has been described with particular reference to a portable, on/off neutron radiography inspection system, it will be understood that it will be equally applicable to collimating thermal neutrons for other purposes. Furthermore, variations in geometry, materials and dimensional characteristics of the collimator will be readily apparent to those of ordinary skill in the art and it will be appreciated that such changes and modifications may be resorted to without departing from the spirit and scope of the invention as defined by the appended claims.

We claim:

1. Apparatus for collimating thermal neutrons produced from neutron sources of approximately 14 MeV or lower comprising:

a hollow tube having a neutron permeable inlet communicating with a thermal neutron source and an open outlet disposed downstream of the inlet at the opposite end of the tube; and the walls of said tube diverging at a constant rate toward the outlet end, the walls of said tube having three radial layers comprising an outer layer continuous for the substantial length of said walls for absorbing thermal neutrons, an intermediate layer continuous for the substantial length of said walls for absorbing X-rays and gamma rays and an inside layer for providing structural support.

2. The apparatus of claim 1 wherein the rate of divergence of said walls is less than about 10 degrees.

3. The apparatus of claim 2 wherein the rate of divergence of said walls is between 5 and 7 degrees.

4. The apparatus of claim 1 wherein said outer layer is cadmium and said intermediate layer is lead.

5. The apparatus of claim 4 wherein said cadmium layer is relatively thinner than said inside layer and said inside layer is relatively thinner than said lead layer.

6. In combination:

a fast neutron source having an output portion for discharging fast neutrons having energy of approximately 14 MeV or lower;

a moderator material surrounding the output portion of said fast neutron source for rapidly diffusing said fast neutrons into randomly scattered thermal neutrons; and a collimator tube disposed in said moderator material near the output portion of said neutron source, said collimator tube having a relatively narrow neutron permeable inlet disposed in said moderator material for admitting neutrons travelling generally parallel to the axis of said collimator tube and having an outlet at the downstream end of the tube for discharging a collimated thermal neutron beam, said collimator tube having outwardly diverging walls having three radial layers comprising a continuous outer layer of thermal neutron absorbing material, a continuous intermediate layer of X-ray and gamma ray absorbing material and an inside layer of aluminum.

7. A selectively activated apparatus for producing thermal neutrons comprising:

a high voltage source;

an ion accelerator neutron tube connected to said high voltage source for producing a stream of fast neutrons when selectively energized by said source;

a moderator material surrounding the output portion of said neutron tube for diffusing said fast neutrons into thermal energy neutrons;

a collimator tube disposed in said moderator material adjacent the output portion of said accelerator tube; and said collimator tube having a relatively narrow neutron permeable inlet portion disposed in said moderator material for admitting neutrons travelling generally parallel to the axis of the collimator tube and having an output portion of the downstream end of the tube, said collimator tube having outwardly diverging walls having three radial layers comprising a continuous outer layer of neutron absorbing material, a continuous intermediate layer of X-ray and gamma ray absorbing material and an inside layer for structural support.

8. The apparatus of claim 7 wherein said intermediate layer of X-ray and gamma ray absorbing material is a lead layer having a thickness of approximately 0.3125 inches, said outer layer of neutron absorbing material is a cadmium layer having a thickness of approximately 0.04 inches and said inside aluminum layer has a thickness of approximately 0.063 inches.

9. The apparatus of claim 7 wherein the walls of said collimator tube diverge toward the outlet of said tube at an angle of not more than about 10 degrees.

10. The apparatus of claim 9 wherein the walls of said collimator diverge at an angle between 5 and 7 degrees.

11. The apparatus of claim 7 wherein said collimator tube is rectangular in cross section.

12. Apparatus for collimating thermal neutrons produced from neutron sources of approximately 14 MeV or lower comprising:

a hollow tube having a neutron permeable inlet communicating with a thermal neutron source and an open outlet disposed downstream of the inlet at the opposite end of the tube;

the walls of said tube diverging at a constant rate toward the outlet end, the walls of said tube having three radial layers comprising an outer layer for absorbing thermal neutrons, an intermediate layer for absorbing X-rays and gamma rays and an inside layer for providing structural support; and neutron permeable means for facilitating collection of thermal neutrons, said means being connected upstream of said inlet and comprising structure having outwardly flared side walls coincident with said collimator walls and being closed by a forward wall parallel to said inlet.

13. The apparatus of claim 12 wherein said forward wall is formed of an outer layer of aluminum and with an inner layer of lead bonded thereto.

14. A selectively activated apparatus for producing thermal neutrons comprising:

a high voltage source;

an ion accelerator neutron tube connected to said high voltage source for producing a stream of fast neutrons when selectively energized by said source;

a moderator material surrounding the output portion of said neutron tube for diffusing said fast neutrons into thermal energy neutrons;

a collimator tube disposed in said moderator material adjacent the output portion of said accelerator tube;

said collimator tube having a relatively narrow neutron permeable inlet portion disposed in said moderator material for admitting neutrons travelling generally parallel to the axis of the collimator tube and having an output portion of the downstream end of the tube, said collimator tube having outwardly diverging walls having three radial layers comprising an outer layer of neutron absorbing material, an intermediate layer of X-ray and gamma ray absorbing material and an inside layer for structural support; and a neutron permeable means for facilitating collection of thermal neutrons, said means being connected upstream of said inlet and comprising structure having outwardly flared side walls diverging upstream of said inlet and coincident with said collimator walls and being closed by a forward neutron permeable wall parallel to said inlet.

15. The apparatus of claim 14 wherein said forward wall is formed of an outer layer of aluminum with an inner layer of lead bonded thereto.

* * * * *